United States Patent [19]

Stupay

[11] 4,291,931

[45] Sep. 29, 1981

[54] SHEAR PLANE SEPARABLE CONNECTOR

[75] Inventor: Lawrence J. Stupay, Thousand Oaks, Calif.

[73] Assignee: Bunker Ramo Corporation, Oak Brook, Ill.

[21] Appl. No.: 11,384

[22] Filed: Feb. 12, 1979

[51] Int. Cl.[3] ..... H01R 13/62

[52] U.S. Cl. ..... 339/45 R

[58] Field of Search ..... 339/45, 46, 75 R, 75 A, 339/75 M, 91 R

[56] References Cited

U.S. PATENT DOCUMENTS

| | | | |
|---|---|---|---|
| 2,997,682 | 8/1961 | Grimes et al. | 339/45 M |
| 3,111,355 | 11/1963 | Samburoff et al. | 339/45 M |
| 3,245,319 | 4/1966 | Kossan et al. | 339/45 R |
| 3,488,623 | 1/1970 | Stephenson et al. | 339/91 R |
| 3,680,033 | 7/1972 | Kawai | 339/91 R |

*Primary Examiner*—Joseph H. McGlynn

*Attorney, Agent, or Firm*—F. M. Arbuckle; A. Freilich

[57] ABSTRACT

A system is provided for disconnecting a retained electrical connector on a missile launcher, from a launched connector on the missile, as the missile begins moving during launch, which is simple, reliable, and reusable. The retained connector, which is supported by a parallogram linkage to cause automatic retraction during launch, is initially fastened to the launched connector by a bolt. The bolt is automatically released during launch by the initial retraction of a sleeve on the retained connector which releases a split threaded collet on the mating connector to allow the collet to open and release from the bolt.

10 Claims, 13 Drawing Figures

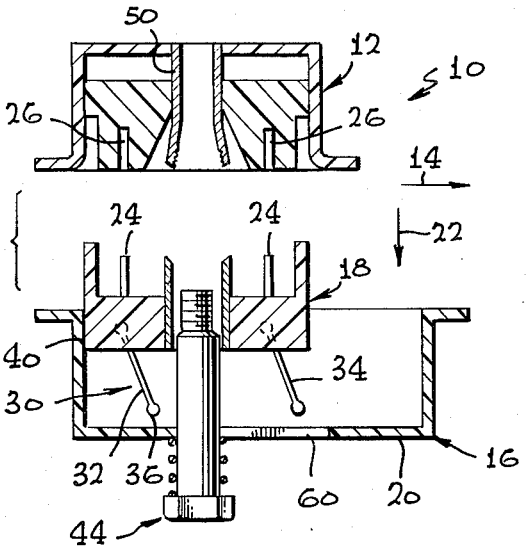
FIG. 1
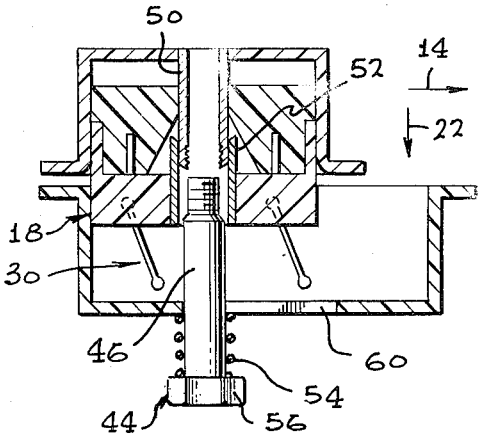
FIG. 2
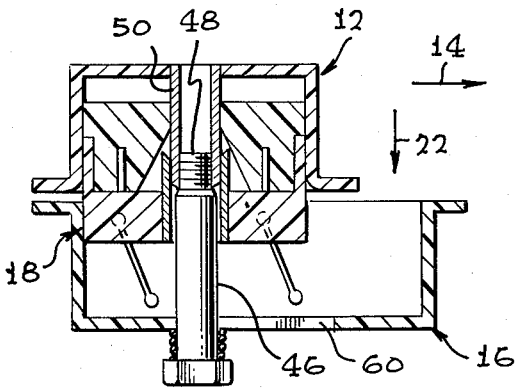
FIG. 3
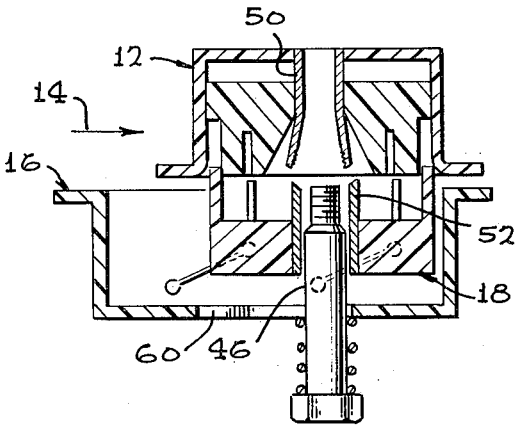
FIG. 4
FIG. 11
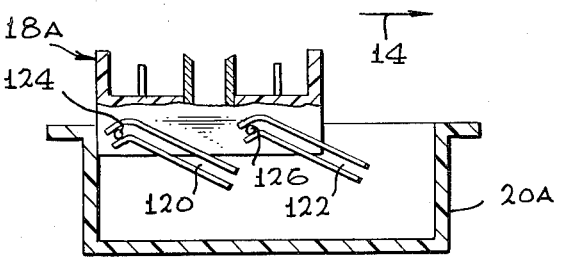

SHEAR PLANE SEPARABLE CONNECTOR

BACKGROUND OF THE INVENTION

Many connection systems such as those utilized to connect a vehicle with a launcher, require the disengagement of connectors when one of them begins moving in a launch direction. A common design approach employed in the connection of missiles to their launchers, is to utilize an explosive or other shear mechanism which literally cuts all contacts along the shear plane. This procedure is costly and requires the installation of new connectors for every launch. Another approach described in U.S. Pat. No. 3,215,970 is to use a parallelogram structure to move the retained connector away from the launched one, but the security of the connection before launch is not as high as desirable. A reusable connection system of reliable design, would reduce the cost of providing connections for missile launching and in other applications.

SUMMARY OF THE INVENTION

In accordance with one embodiment of the present invention, a relatively simple reusable connection system is provided for automatically disengaging a pair of mated connectors during movement of one connector in a forward or launch direction which is largely perpendicular to the axes of the connectors. The system includes a guiding mechanism for a retained connector, that guides it along a path with a portion that is angled from the forward direction by less than 90°, to move the retained connector progressively away from the other, or launched connector, as the connectors begin moving along the forward direction. The guiding mechanism can include a parallelogram structure having a pair of links with inner ends pivotally connected to the launcher or other stationary base, and outer ends pivotally connected to the retained connector. The security of the connection prior to launch, can be enhanced by a holding mechanism that includes a bolt on the launching structure or other base, which threadably engages a split collet on the launched connector, and with the collet normally squeezed tightly around the bolt by a stripper sleeve on the retained connector. During launch, as the retained connector moves partially away from the launched connector, the stripper sleeve releases the collet which, in turn, releases the bolt to allow a spring to withdraw the bolt from the launched connector.

The parallelogram structure can be biased towards its retracted position to assure that the retained connector moves clear of a launched missile or the like after unmating, using a spring which also serves to hold the retained connector in its mated or unretracted position. This is accomplished by allowing the parallelogram structure to lie slightly past dead center when mated to the launched connector, and by utilizing a spring which applies a force perpendicular to the launch direction.

The novel features of the invention are set forth with particularity in the appended claims. The invention will be best understood from the following description when read in conjunction with the accompanying drawings.

BRIEF DESCRIPTION OF THE DRAWINGS

FIG. 1 is a simplified sectional side view of a connector system constructed in accordance with the present invention, shown prior to mating of the connectors thereof.

FIG. 2 is a view of the system of FIG. 1, shown with the connectors mated, but prior to fastening of the holding mechanism.

FIG. 3 is a view of the connector system of FIG. 2, but shown with the holding mechanism fastened, to complete the connection.

FIG. 4 is a view of the system of FIG. 3, shown in the course of launch of a vehicle containing one of the connectors, shown near the end of separation of the connectors.

FIG. 11 is a simplified sectional side view of a retained connector constructed in accordance with another embodiment of the invention.

DESCRIPTION OF THE PREFERRED EMBODIMENTS

Figure 3A:
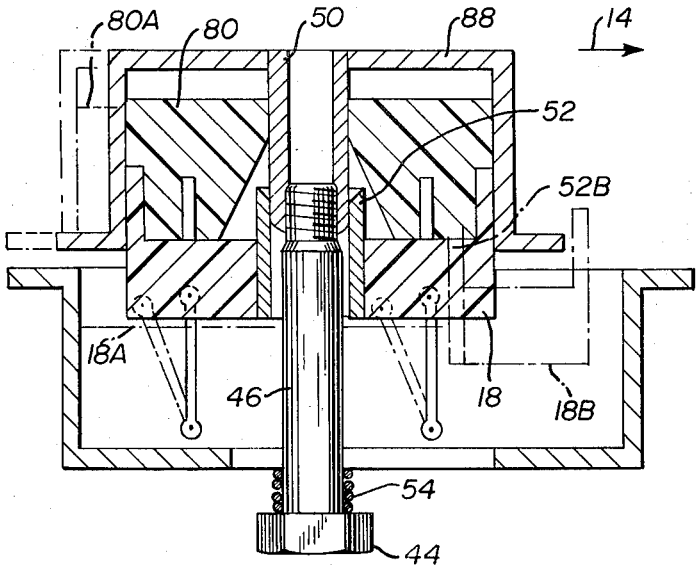
FIG. 3A is a view of the connector system of FIG. 2, but shown in the course of launch, at a dead center position.

FIG. 1 illustrates a connector system 10 which includes a launched connector 12 designed to be mounted on a missile that is to be launched in the direction of arrow 14, and a connector assembly 16 that includes a retained connector 18 that can mate with the launched connector 12. The retained connector 18 is essentially retained on a missile launcher or other base 20, although the connector 18 can move a small distance during unmating from the launched connector 12 in the course of missile launching. The particular connector system 10 is designed for reuse during several different launches. To this end, it is necessary that demating of the connectors 12, 18 occur by retraction of one of the connectors such as 18 in an unmating direction, indicated by arrow 22, and without rotation of the connectors that could cause damage to the pin contact elements 24 of one of the connectors 18 that are received in corresponding socket contact elements 26 of the other connector.

Automatic disengagement of the connectors during launch is achieved by mounting one of the connectors 18 on a parallelogram-like structure 30. The structure 30 includes a pair of links 32, 34 having inner ends 36 pivotally mounted on the base 20 and outer ends pivotally mounted on the connector 18, with the pivot axes of the links forming the corners of a parallelogram. This support structure enables the retained connector 18 to advance in the launch direction 14 when the launched connector is moving in that direction, while also assuring that such motion causes the retained connector 18 to progressively withdraw in the unmating direction 22, from the launched connector. FIG. 4 illustrates the connector system 10 near the completion of an unmating operation, wherein the launched connector 12 has moved a distance in the launch direction 14, causing the parallelogram structure 30 to move the retained connector 18 in that direction for a short distance while withdrawing the retained connector until it is unmated from the connector 12.

It may be noted that in the initial position shown in FIG. 1, the parallelogram structure 30 is in an "overcenter" position, wherein the links 32, 34 have rotated passed an orientation parallel with the unmating direction 22, and the connector 18 rests against a stop 40 formed on the base. This permits a technician to force the launch connector 12 hard against the other connector 18 to mate them, without causing the connector 18 to withdraw. FIG. 2 shows the connectors 12, 18 in a mated condition. When the launched connector 12 begins to move in the launch direction 14, the overcenter parallelogram structure 30 will initially cause the retained connector 18 to move slightly towards the launched connector 12 in a direction opposite to the unmating direction 22. However, by positioning the stop 40 only slightly past the deadcenter position, there is only slight movement of the connector 18 towards the other connector 12.

Figure 3B:
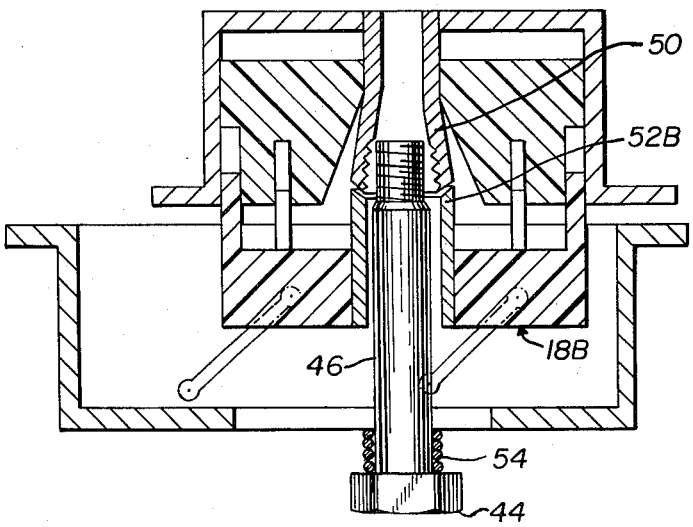
FIG. 3B is a view similar to FIG. 3A but at a later position in the course of launch.

In many applications, it is desirable to fasten the two connectors 12, 18 together with greater security than is provided merely by the contact force between the pins 24 and sockets 26, particularly where it is desired to form a seal about the region containing these contact elements. In accordance with another feature of the invention, this is accomplished by utilizing a holding mechanism 44, as shown in FIG. 3, which includes a fastener such as bolt 46 with a threaded outer end 48 that can be threadably received in a split collet 50 on the launched connector 12. The bolt 46 is slidable in the unmating direction 22 relative to the retained connector 18 and relative to the base 20, but advances in the launch direction 14 along with the connector 18.

When the connectors 12, 18 are first mated, as shown in FIG. 2, a stripper sleeve 52 on the retained connector 18 moves closely about the split collet 50 to close it. The bolt 46 is initially held in a retracted position by a spring 54. However, the head 56 of the bolt can be pressed up and turned, to threadably engage the bolt end 48 with the internal threads of the collet 50. As the bolt 46 is tightened, it compresses the spring 54, until the bolt is in the position shown in FIG. 3.

During vehicle launch, the bolt 46 initially slides in the launch direction 14 along with both of the connectors 12, 18. During initial movement of the connector 18 from the position of FIG. 3 to the dead center position of FIG. 3A, the connector 18 moves slightly upwardly from its initial position at 18A. The receptacle insert 80 also moves up slightly from the position 80A, since the insert can slide up and down within the receptacle shell 88. However, the bolt 46 does not move up or down since the collet 50 does not move up or down. As the vehicle continues to move in a launch direction from the dead center position shown in solid lines in FIG. 3A, the connector moves to the position 18B shown in phantom lines in FIG. 3A and in solid lines in FIG. 3B. At this position, the sleeve at 52B has moved downward so that its extreme top has just moved below the bottom of collet 50. The collet 50 then can open to release the bolt 46, and the bolt can suddenly slide down under the force of the spring 54. As the collet 50 opens, it releases the bolt 46, and the bolt then rapidly withdraws under the force of the spring 54. Thus, the connectors can be securely held together by a separate fastener prior to launch, and yet the fastener is automatically released during launch.

Figure 5:
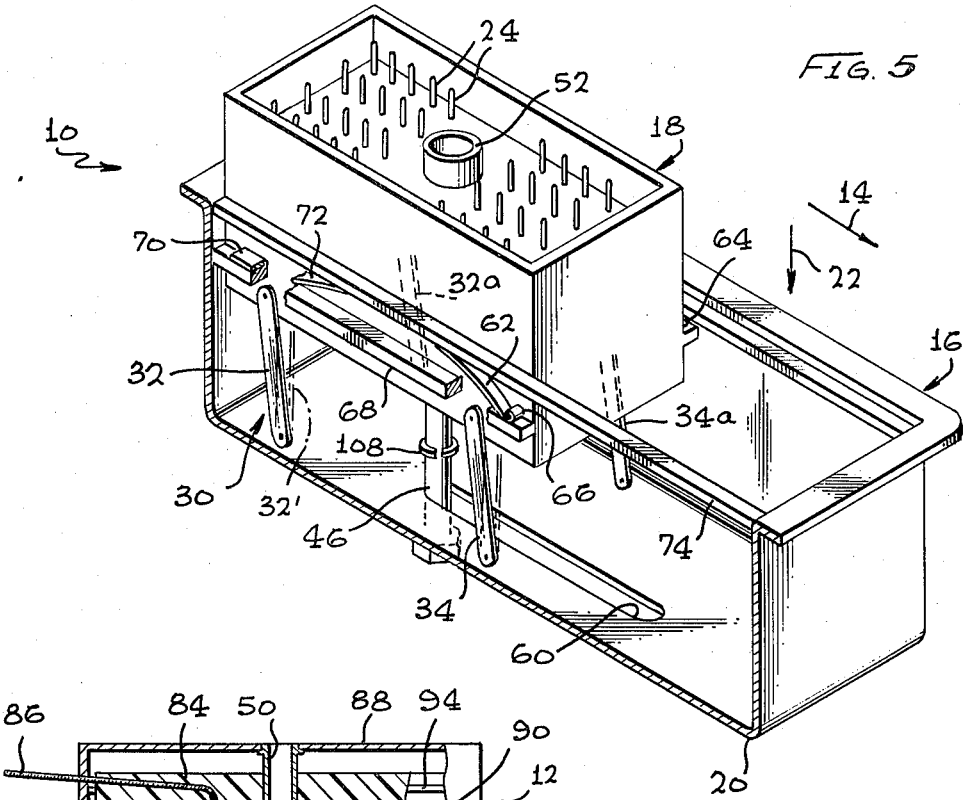
FIG. 5 is a more detailed partially sectional perspective view of the retained connector shown in FIG. 1.

FIG. 5 illustrates the retained connector assembly 16 of FIGS. 1–4 in greater detail. It can be seen that the base 20 comprises a cannister that closely receives the retained connector 18. The parallelogram structure 30 includes a pair of links 32, 34 on one side of the connector 18 and another similar pair **32*a*, 34*a* on the other side, with the inner ends of all links pivotally mounted on the cannister 20. It can be seen that the cannister has a slot 60 along which the bolt 46 can travel in the launch direction 14 and in the unmating direction 22. It also can be seen that the assembly includes a pair of leaf-springs 62, 64 on either side of the connector 18, which urge the connector 18 to move in the unmating direction 22. Each of the leaf spring, such as 62, has a captured end 66 lying on a flange or lip 68 formed on the connector 18, an opposite free end 70 also lying on the lip 68, and a middle portion 72 bearing against an internal flange 74 formed on the inside of the cannister 20. The leaf spring 62 therefore continually urges the connector 18 in the unmating direction 22**.

The leaf springs 62, 64 that continually urge the the retained connector 18 in the unmating direction, are useful to assure that the connector 18 will move clear of any slightly protruding parts of the launched vehicle after the retained connector unmates from the launched connector. It would be possible to achieve the same spring bias of the connector 18 towards its unmated position, by torsion springs mounted on the links such as 32, 34 to urge them to continually pivot towards the unmated position. However, such spring bias towards the unmated position would prevent the connector 18 from remaining in its initial position shown in FIG. 5 wherein it lies against the stop 40. The fact that the parallelogram mechanism 30 is past top deadcenter and the spring force is directly in the unmating direction 22, means that the spring force 22 initially presses the connector 18 against the stop 40, thereby holding the connector 18 in this position once it is moved thereto. Only during launch of the vehicle, when the connector 18 moves passed a top center position wherein its links such as 32 extend parallel to the force of the spring as shown for the link at 32', does the force of the springs 62, 64 urge the connector 18 to move in the launch direction 14 as well as the unmating direction 22.

FIGS. 6–10 illustrate some additional details of the connector system 16. The launched connector 12 includes a pair of receptacle inserts 80, 82 (FIG. 6) and a potting mass 84 held at the rear of the inserts, to facilitate mounting of the socket contacts 26 and of a cable 86 that passes through a shell 88 of the launched connector. A pair of leaf springs 90 on either side of the shell 88, are mounted on a lip 92 of the inserts and bear against an internal flange 94 on the shell, to urge the inserts 80, 82 towards the connector 18. The spring 90 permits slight movement of the inserts 80, 82 in the unmating direction 22, to press the engaging portions of the two connectors into intimate contact when they are mated. The springs 90 also permit the inserts 80, 82 to withdraw slightly, in a direction opposite to the mating direction 22, as the links such as 32, 34 initially pivot and cause the retained connector to move slightly towards the launched connector 12 as the links approach top center position.

The launched connected 12 includes a cover 100 (FIG. 10) which is biased towards a closed position by a spring 102, to enable the automatic covering of the launched connector 12 after it is launched, to protect the connector against contamination.

Figure 6:
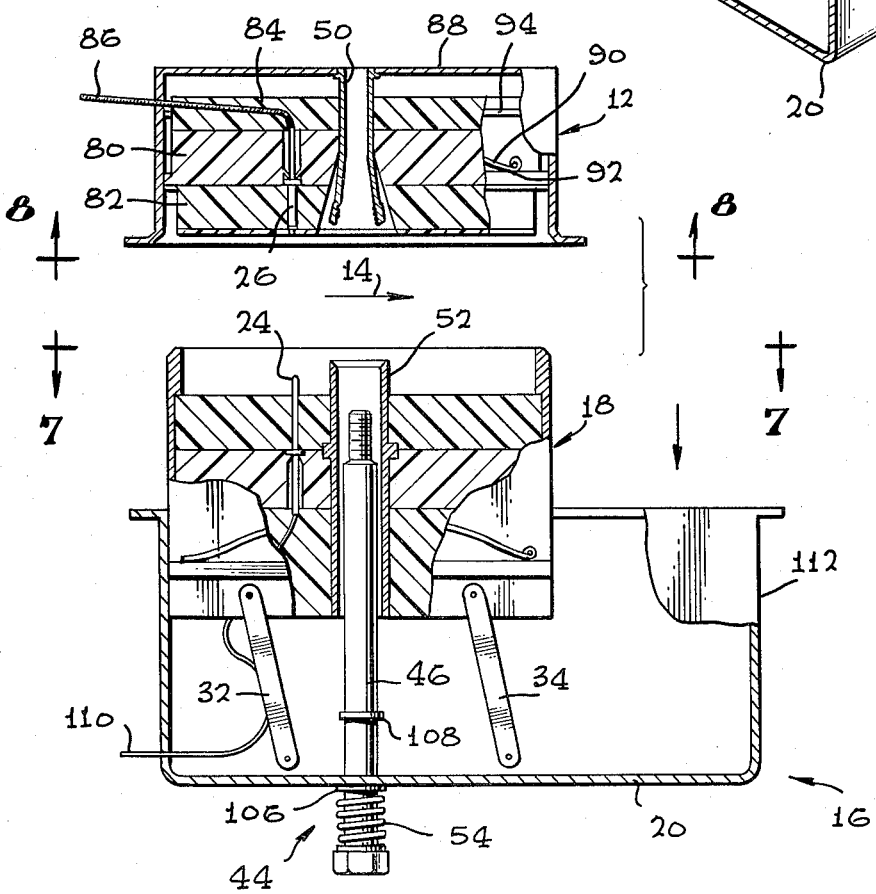
FIG. 6 is a more detailed partially sectional and partially elevation view of the connector system of FIG. 1, including the retained connector of FIG. 5 and the launched connector of the system.
Figure 7:
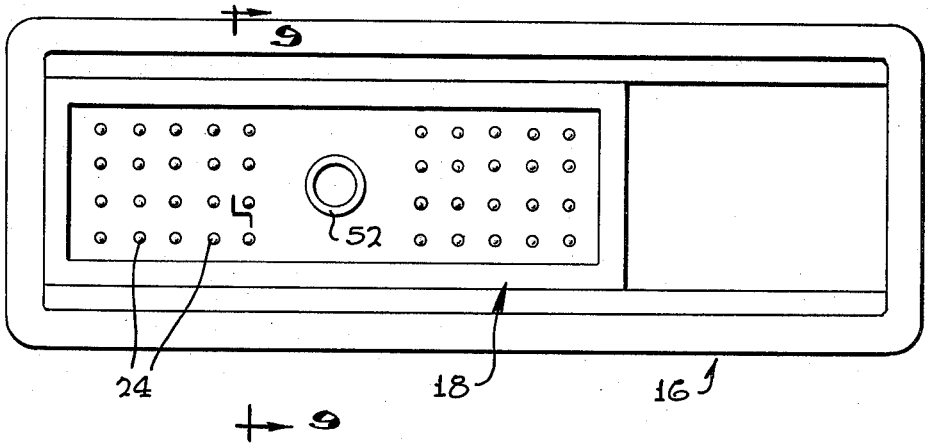
FIG. 7 is a view taken on the line 7—7 of FIG. 6.
Figure 8:
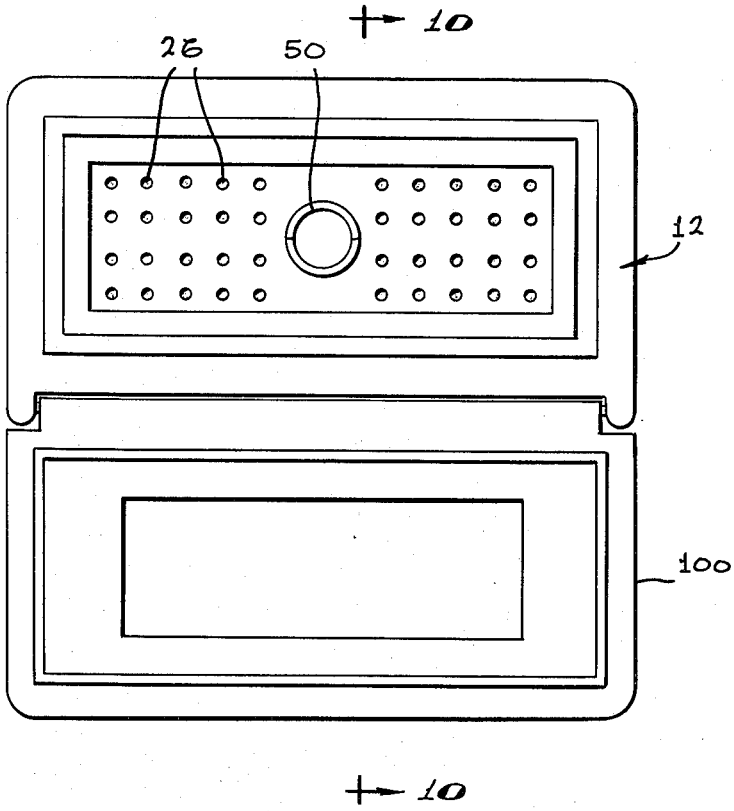
FIG. 8 is a view taken on the line 8—8 of FIG. 6.
Figure 9:
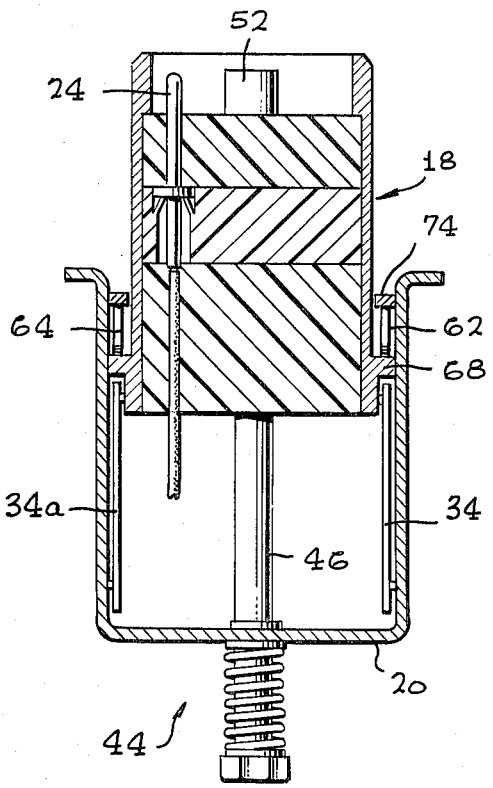
FIG. 9 is a view taken on the line 9—9 of FIG. 7.
Figure 10:
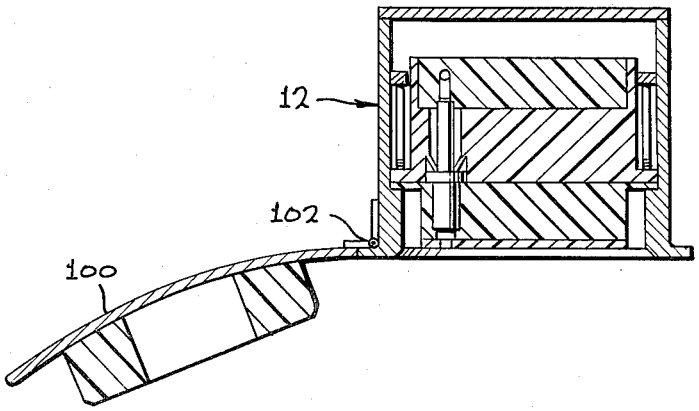
FIG. 10 is a view taken on the line 10—10 of FIG. 8.

In the retained connector 18 shown in FIG. 6, it can be seen that the bolt 46 of the holding mechanism 44 is slidably guided by the use of a low friction washer 106 of a material such as Teflon between the upper end of the spring 54 and the cannister 20. A snap ring 108 is also provided along the bolt to prevent loss of the bolt when it is released to move down. It may be noted that a cable 110 is provided which has a flexible loop, to connect to the pin contacts 24. When the parallelogram structure moves the connector 18 in the launch direction 14, the connector 18 is stopped by a wall portion 112 of the cannister 20, to prevent sharp bending of the cable 110.

Although a parallelogram structure provides a reliable and low friction support mechanism for moving the retained connector at an angle to the launch direction, to progressively withdraw the retained connector from the other one during launch, and to also prevent rotation of the retained connector during its unmating or withdrawal, it is also possible to utilize other guiding mechanisms. For example, FIG. 11 shows a pair of guideways 120, 122 mounted on a cannister 20A, which guide a pair of pins 124, 126 projecting from a retained connector 18A, to guide the retained connector in a path that extends partially parallel to the launch direction 14, but which is angled by an acute angle therefrom to cause withdrawal of the retained connector.

Thus, the invention provides a connector assembly of relatively simple design, which automatically unmates a retained connector from a launched connector on a vehicle during movement of the vehicle in a launch direction which is substantially perpendicular to the unmating direction. This can be accomplished by mounting the retained connector on a guiding and confining means that confines the retained connector to movement along a path portion angled from the launch direction but by less than 90°, for moving the retained connector progressively away from the other connector as the two of them advance along the launch direction. A parallelogram like structure can be utilized to confine movement of the retained connector in this way, while also preventing rotation of the connector during its unmating from the other one. A holding mechanism can be utilized to provide an auxiliary fastener that securely holds the two connectors together prior to launch, and which automatically disengages during launch. This can be accomplished by utilizing a split collet to hold a bolt or other fastener that moves in the launch direction with the retained connector, and by utilizing a stripper sleeve on the connector which holds the collet closed over the fastener prior to launch, and which releases the collet to open in the course of launch to thereby release the fastener. A spring can be utilized to hold the retained connector in its initial position, and also to urge the retained connector to withdraw from the launch vehicle near the end of unmating, by utilizing a spring that urges the retained connector in the unmating direction, and by positioning the parallelogram or other guiding mechanism so the retained connector is past top deadcenter in its initial position.

Although particular embodiments of the invention have been described and illustrated herein, it is recognized that modifications and variations may readily occur to those skilled in the art and consequently, it is intended that the claims be interpreted to cover such modifications and equivalents.

The embodiments of the invention in which an exclusive property or privilege is claimed are defined as follows:

1. In a connection arrangement which includes a first connector movable from an initial position together with a vehicle means along a first direction, and which can be demated from a second connector by movement of the second connector in a demating second direction wherein the second direction is largely perpendicular to said first direction, the improvement of means for demating said connectors comprising:

means confining said second connector to movement along path portions wherein the path portions are angled by less than 90° from an imaginary line parallel to said first direction, during movement of said second connector in either of two opposite directions away from a predetermined deadcenter position;

stop means limiting movement of said second connector to an extreme position spaced away from said deadcenter position in a direction opposite to said first direction; and spring means which urges said second connector in said demating second direction during initial movement of said second connector from said extreme position to said deadcenter position so that said spring means opposes such initial movement, and which urges said second connector in said demating second direction during subsequent movement beyond said deadcenter position and away from said extreme position to aid in such subsequent movement.

2. The improvement described in claim 1 wherein:

said confining means includes a base which remains substantially stationary with respect to movement of said first connector parallel to said first direction, and a pair of links having inner ends pivotally mounted on said base and outer ends pivotally connected to said second connector;

said links extending, as measured between the pivot axes of each link, parallel to said demating second direction when said second connector is at said deadcenter position.

3. The improvement described in claim 1 wherein:

one of said connectors includes a shell, an insert slidably mounted on said shell to move toward and away from the other connector, a plurality of contact elements fixed to said insert, and a spring urging said insert toward the other connector.

4. The improvement described in claim 1 including:

a holding mechanism which includes a split collet mounted on said first connector, a sleeve mounted on said second connector to closely surround said collet when said connectors are mated, and a fastener mounted to move relative to the second connector in a direction largely parallel to said mating direction, said fastener having an outer portion which can be captured by said collet;

said sleeve positioned on said second connector to withdraw from around said collet, so the collet can open to release the fastener as the second connector withdraws from the first connector.

5. The improvement described in claim 1 including:

a cover pivotally coupled to said first connector and spring biased toward a closed position thereon, to automatically close over and protect said first connector immediately after it is unmated from said second connector.

6. A connector assembly which can automatically unmate from another connector device mounted on a vehicle, as the other connector device moves in a launch direction with the vehicle, comprising:

a substantially stationary base;

a connector;

a structure coupling said connector to said base, including a pair of substantially parallel links having inner ends pivotally connected to said base and outer ends pivotally connected to said connector;

spring means urging said connector in a direction substantially away from the connector device on the vehicle; and stop means for limiting movement of said coupling structure in a direction opposite to said launch direction, at a predetermined overcenter position wherein the force of said spring means urges said connector in a direction opposite to said launch direction.

7. A connector system comprising:

first and second connectors which move together to mate and move apart to unmate;

a first of said connectors having a collet means which can close against a fastener to hold it and open away from the fastener to release it;

a second of said connectors having means engageable with said collet means to hold it closed when the connectors are mated, but which releases the collet means to open when the connectors are moving apart to unmate; and a fastener which can slide in the unmating direction relative to said second connector, and which is holdable by said collet means when the collet means is closed, and releasable to move away from the collet means when the collet means opens; and means coupling said second connector to said fastener, to transmit connector holding forces from said fastener to said second connector, whereby when the collet means holds the fastener, the connectors are securely held together.

8. The system described in claim 7 wherein:

said coupling means includes a base and a parallelogram structure holding the second connector to the base, said base having a wall with a slot and said fastener passing through said slot and having a head on a side of the wall opposite the first connector.

9. In a connection arrangement which includes a first connector movable from an initial position together with a vehicle means along a first direction, and which can be demated from a second connector by movement of the second connector in a demating second direction which is largely perpendicular to said first direction, the improvement of means for demating said connectors comprising:

means confining said second connector to movement along a path portion angled from said first direction but by less than 90°, for moving said second connector progressively away from said first connector as the first connector advances along said first direction; and a holding mechanism which includes a split collet mounted on said first connector, a sleeve mounted on said second connector to closely surround said collet when said connectors are mated, and a fastener mounted to move relative to the second connector in a direction largely parallel to said mating direction, said fastener having an outer portion which can be captured by said collet;

said sleeve positioned on said second connector to withdraw from around said collet, so the collet can open to release the fastener as the second connector withdraws from the first connector.

10. The improvement described in claim 9 wherein:

said means confining said second connector includes a base having a wall forming a slot extending substantially parallel to said first direction;

said fastener comprises a bolt with a threaded outer end that can threadably engage said collet, and said bolt extends through said slot in said base; and said holding mechanism includes a coil spring disposed about the bolt portion which lies on a side of the base wall opposite the connector, to urge said bolt outer end to withdraw from the collet.

* * * * *